US005897390A

United States Patent [19]

Yamagami et al.

[11] Patent Number: 5,897,390

[45] Date of Patent: Apr. 27, 1999

[54] ELECTRICAL CONNECTOR

[75] Inventors: Yoku Yamagami; Hirokatsu Yaegashi; Tsuyoshi Sakata; Tsutomu Matsuo, all of Tokyo, Japan

[73] Assignee: Hirose Electric Co., Ltd., Tokyo, Japan

[21] Appl. No.: 08/845,389

[22] Filed: Apr. 25, 1997

[30] Foreign Application Priority Data

Apr. 26, 1996 [JP] Japan ..... 8-106665

[51] Int. Cl.[6] ..... H01R 13/62

[52] U.S. Cl. ..... 439/326

[58] Field of Search ..... 439/326, 327, 439/328, 296

[56] References Cited

U.S. PATENT DOCUMENTS 5,176,531 1/1993 Lin ..... 439/326

5,584,711 12/1996 Arai et al. ..... 439/326

*Primary Examiner*—Steven L. Stephan

*Assistant Examiner*—Eugene G. Byrd

*Attorney, Agent, or Firm*—Kanesaka & Takeuchi

[57] ABSTRACT

An electrical connector includes a board latch which has an L-shaped engaging arm for latching a board. The outside face of a free end of the engaging arm is flush with the outside face of a vertical portion of the engaging arm. A ridge is provided on the engaging arm for positioning the board in the longitudinal direction of a board receiving slot.

12 Claims, 12 Drawing Sheets

ELECTRICAL CONNECTOR

BACKGROUND OF THE INVENTION

1. Field of the Invention

The present invention relates to electrical connectors having a board latch and methods for making them and, more particularly, to improvements in the board latch and a method for making the board latch.

2. Description of the Related Art

U.S. Pat. 4,850,892 and Japanese patent application Kokai No. 272796/95 disclose electrical connectors of this type. FIGS. 10 and 11 show an electrical connector such as shown in JP '796. FIG. 10 shows the left side portion of an insulation housing for the electrical connector and FIG. 11 shows the same portion viewed from the back.

The insulation housing of the electrical connector is provided with a board receiving slot 111 extending in the longitudinal direction of the insulation housing. A plurality of contact terminals (not shown) are arranged in the board receiving slot 111 for electrical connection with pads provided on the front edge of a board which is to be inserted into the board receiving slot 111.

A pair of engaging arms 125 and a pair of abutment walls 124B are provided at opposite ends of the board receiving slot 111. The engaging arms 125 extend upwardly from the bottom wall of the insulation housing, and the upper free ends are flexible in the longitudinal direction and are provided with latch knobs 20 having latch hooks 126.

To connect a board to the electrical connector, the board is inserted obliquely into the board receiving slot 111. The contact force between the contact terminals and the pads on the front edge is made substantially zero, providing the so-called "zero-insertion-force" structure. Then, the board is rotated toward the abutment walls of the insulation housing. However, there is no positioning device for guiding the front edge of the board to the board receiving slot. As the board is further rotated, its side edges hit the hooks 126 of the engaging arms 125, flexing the engaging arms 125 outwardly in the longitudinal direction. As a result, the board passes the hooks 126 of the engaging arms 125 and, as soon as its back side hits against the abutment walls 124B, the engaging arms 125 snap back to the original positions so that the hooks hold the board in place. Under this condition, the pads of the front edge are brought into contact with the contact terminals arranged in the board receiving slot 111. In such a connection state, the side edges of the board are latched between the abutment walls 124B and the hooks 126 of the engaging arms.

To remove the board from the electrical connector, the knobs 20 of the engaging arms 125 are pushed outwardly to allow the board to rotate and pass the hooks 126 of the engaging arms 125 so that the board is removable from the board receiving slot. The pulling-it-out force is also substantially zero.

FIG. 12 shows the left side portion of a conventional insulation housing having such functions as described above. This figure does not accurately correspond to FIGS. 10 and 11 but shows a view taken along line 12—12 of FIGS. 10 and 11.

As evident from this figure, an upward portion of the engaging arm 125 is made substantially flat. However, a projection 127 is provided on the knob 20 so that the engaging arm 125 projects outwardly at its free end. In order to make such a knob 20 it is necessary to use a movable mold consisting of at least two dies 14 and 15 and a fixed mold.

Especially, the shape of the die 14 is complicated to make the projection of the knob 20. The width of the die 15 is substantially constant along the knob 20, whereas the die 14 has an undercut portion under the projection.

It is necessary to remove these dies upwardly. The biting or sticking power of a resin to core pins of the die for making apertures to retain contact terminals 113 is higher than the sticking power to the engaging arms or abutment walls so that an undercut portion is provided on the upper face 114 of the housing so that the molded insulation housing sticks to the movable mold. Then, the mold insulation housing is removed from the movable mold. The die 15 is removable independently of the die 14, but it is impossible to remove the die 14 before the die 15 because the die 14 has the undercut portion. That is, the die 14 is removed after the die 15 is removed, and the upper end of the engaging arm 125 is flexed inwardly in the longitudinal direction. Where the mold has an undercut portion, it is necessary to provide the mold with such a sequence structure. In addition, to stick to the upper face, the mold must have an undercut portion on the upper face of a housing.

Since the conventional device has a projection on the knob or a portion of the engaging arm projecting outwardly, the mold for making the engaging arm has an undercut portion. To remove the undercut mold, it is necessary to provide the movable mold with the sequence structure, making the mold complicated, resulting in the increased manufacturing costs and the decreased life of the mold owing to damage or wear. The sequence structure requires more process steps than the ordinary molding, making the molding cycle longer than before. In addition, parts biting takes place at the undercut portion or projection on the core pin side, and barr are produced at faces of mold parts, thus restricting the molding conditions. Moreover, the core pins are complicated so that the molded insulation housing sticks to the movable mold and is removed by force, thus making burrs on the insulation housing.

SUMMARY OF THE INVENTION

Accordingly, it is an object of the invention to provide an economical electrical connector able to provide a latch knob without using the undercut portion and lowering the maneuverability of the engaging arm.

When a board is inserted into the board receiving slot and rotated to the latch position, there is a considerable gap between the board and the engaging arms. This gap offsets the board from the contact terminals in the board receiving slot, making positioning of the board difficult. When the board is rotated to the latch position, there is too much play so that the contact terminals in the insulation housing do not accurately correspond to the terminals of the board.

Accordingly, it is another object of the invention to provide an electrical connector able to position accurately a board in the electrical connector.

According to one aspect of the invention there is provided an electrical connector, which include an insulation housing with an elongated central section and at lease one side wall extending upwardly at an end of the central section; a board receiving slot provided in the central section to extend in a longitudinal direction of the central section; a plurality of contact terminals arranged in the board receiving slot; at least one board latch extending upwardly from an end of the board receiving slot for latching a side edge of a board inserted into the board receiving slot such that pads of the board are brought into contact with the contact terminals, the board latch comprising: an L-shaped engaging arm extending laterally from the a joint with side wall and then upwardly to form a vertical portion with a free end so that an outside face of the free end is flush with an outside face of the vertical portion and that the engaging arm is flexible in the longitudinal direction; a hook portion provided on the free end; and an abutment wall cooperating the hook portion for holding a side edge of the board between them.

According to another aspect of the invention there is provided a method for making such an electrical connector with a single metal mold.

According to an embodiment of the invention, a ridge is provided on the engaging arm so as to position accurately the board in the longitudinal direction into the board receiving slot.

According to another aspect of the invention, the ridge extends from a lower end to an upper end of the vertical portion of the engaging arm so as to guide and position the board. The ridge is rounded or tapered to facilitate guiding the board.

Also, the ridge is spaced from the side edge of the board with a gap which is sufficiently small to position accurately the board without play but sufficiently large to slide the board without difficulty.

DESCRIPTION OF THE PREFERRED EMBODIMENT

Figure 1:
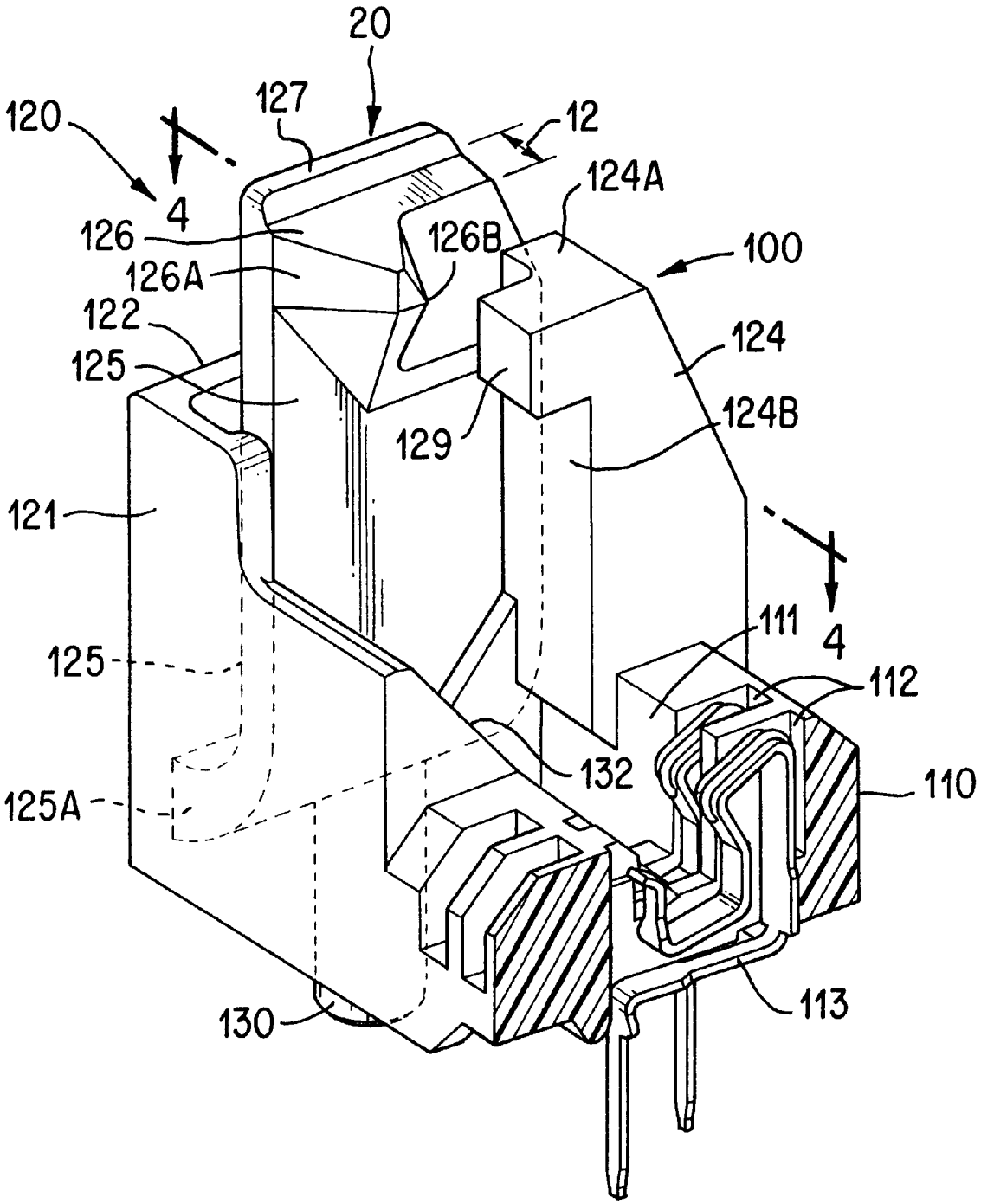
FIG. 1 is a perspective view of the left side portion of an electrical connector according to an embodiment of the invention.
Figure 2:
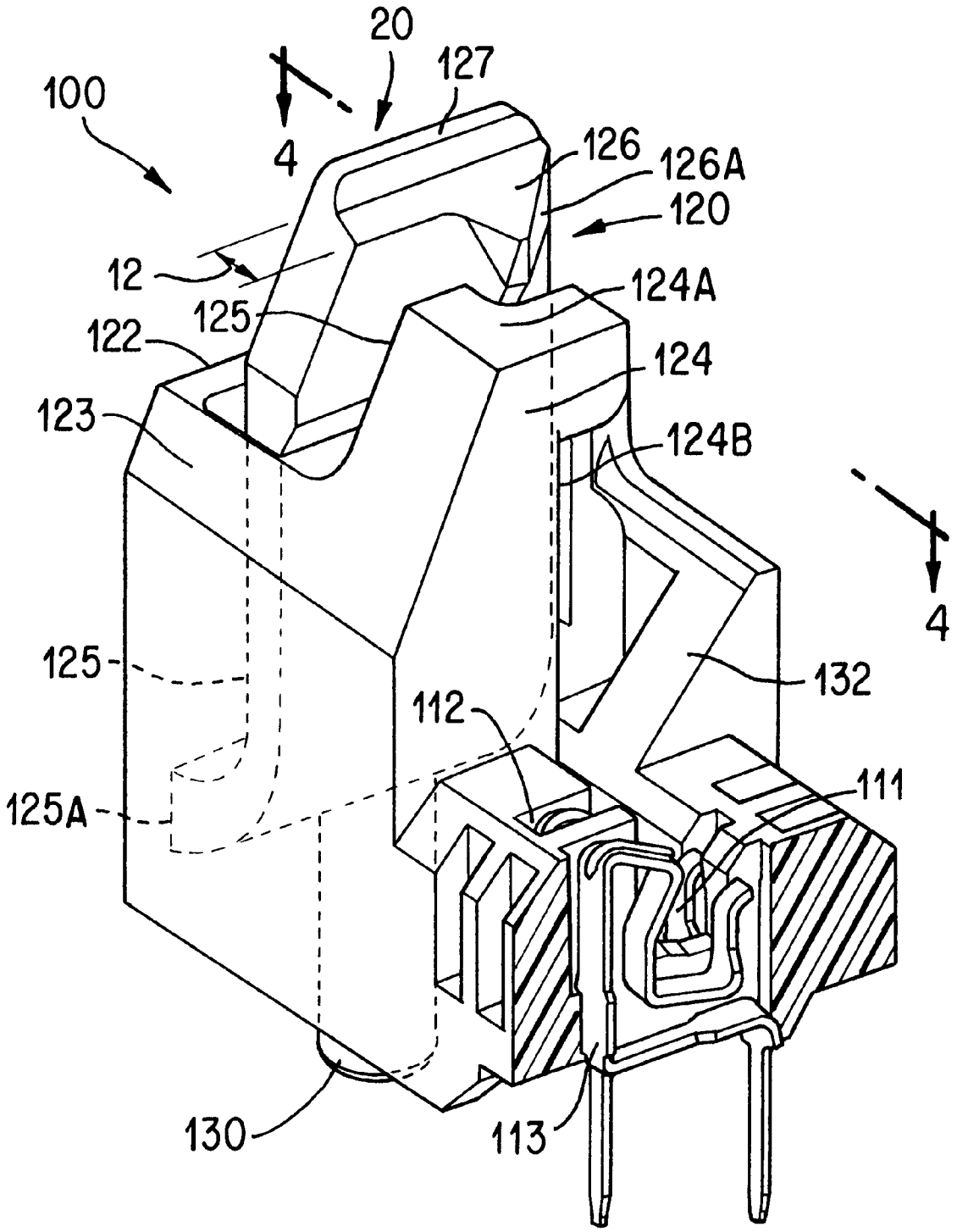
FIG. 2 is a perspective view of the portion viewed from the back.
Figure 3:
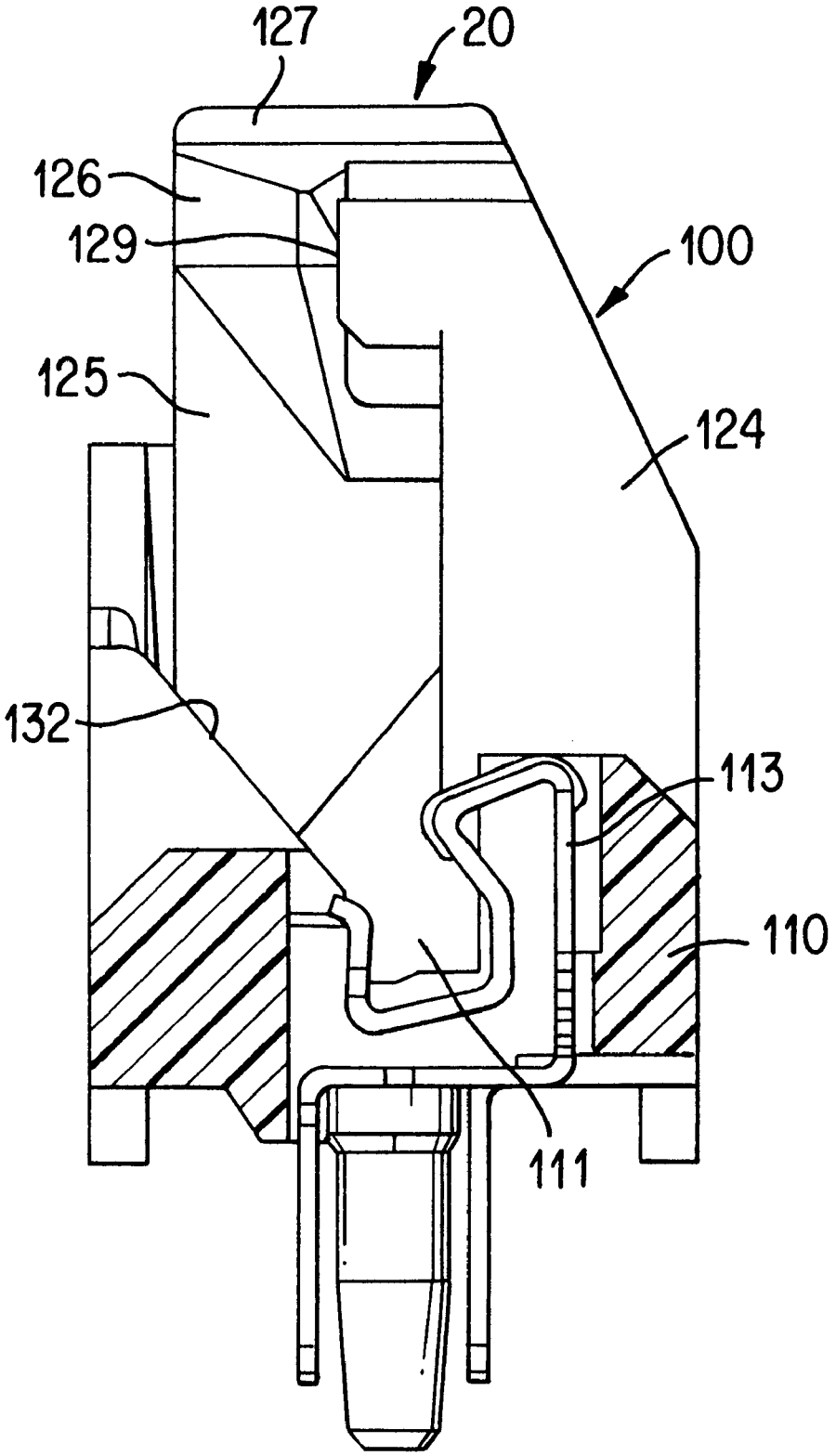
FIG. 3 is a section view of the electrical connector of FIG. 1 cut at the center.

In FIGS. 1–5, an insulation housing 100 has a board receiving slot 111 extending in the longitudinal direction of the insulation housing 100. A plurality of terminal receiving grooves 112 are provided in the inner face of the board receiving slot 111 for receiving a plurality of contact terminals 113.

A board latch 120 is provided at a left side end of the insulation housing 100. Although it is not shown, a board latch identical with the board latch 120 is provided at a right side end of the insulation housing. The insulation housing is molded from an insulation material, such as a plastic, to provide a central section 110 having the board receiving slot 111 and the left and right board latches 120. A pair of guiding slopes 132 are provided between the central section 110 and the board latches 120 for guiding a board at a predetermined angle.

Each board latch 120 consists of an engaging arm 125, and a front wall 121, side wall 122, and a rear wall 123 surrounding the engaging arm 125, and a forwardly projecting wall 124. The distance between opposite ends of the front walls 121 is made slightly larger than the width of a board so as to position the board for insertion and rotation with little play. The opposite ends are rounded or slanted. A projected wall 124A extends from the forward projecting wall 124 to the engaging arm 125. An abutment face 124B is made of the front face of the projected wall 124A to produce such an effect as described hereinafter. A board positioning projection 129 is provided at the upper portion of the front face of the forwardly projecting wall 124 to produce such an effect as described hereinafter.

The engaging arm 125 extends inwardly from the lower end of the side wall 122 and then upwardly, forming a substantially L-shaped structure. A knob 20 is provided on the upper free end, and a projection 127 is provided on the upper end of the knob 20. A hook portion 126 is provided on the front face of the projection 127 to produce such a function as described hereinafter. The engaging arm 125 is flexed outwardly by pushing the projection 127 outwardly. The engaging arm 125, however, is protected against excessive flexure by the front wall 121, the side wall 122, the rear wall 123, and the forwardly projecting wall 124 which surround the engaging arm 125 except the vicinity of the hook portion 126.

Figure 12:
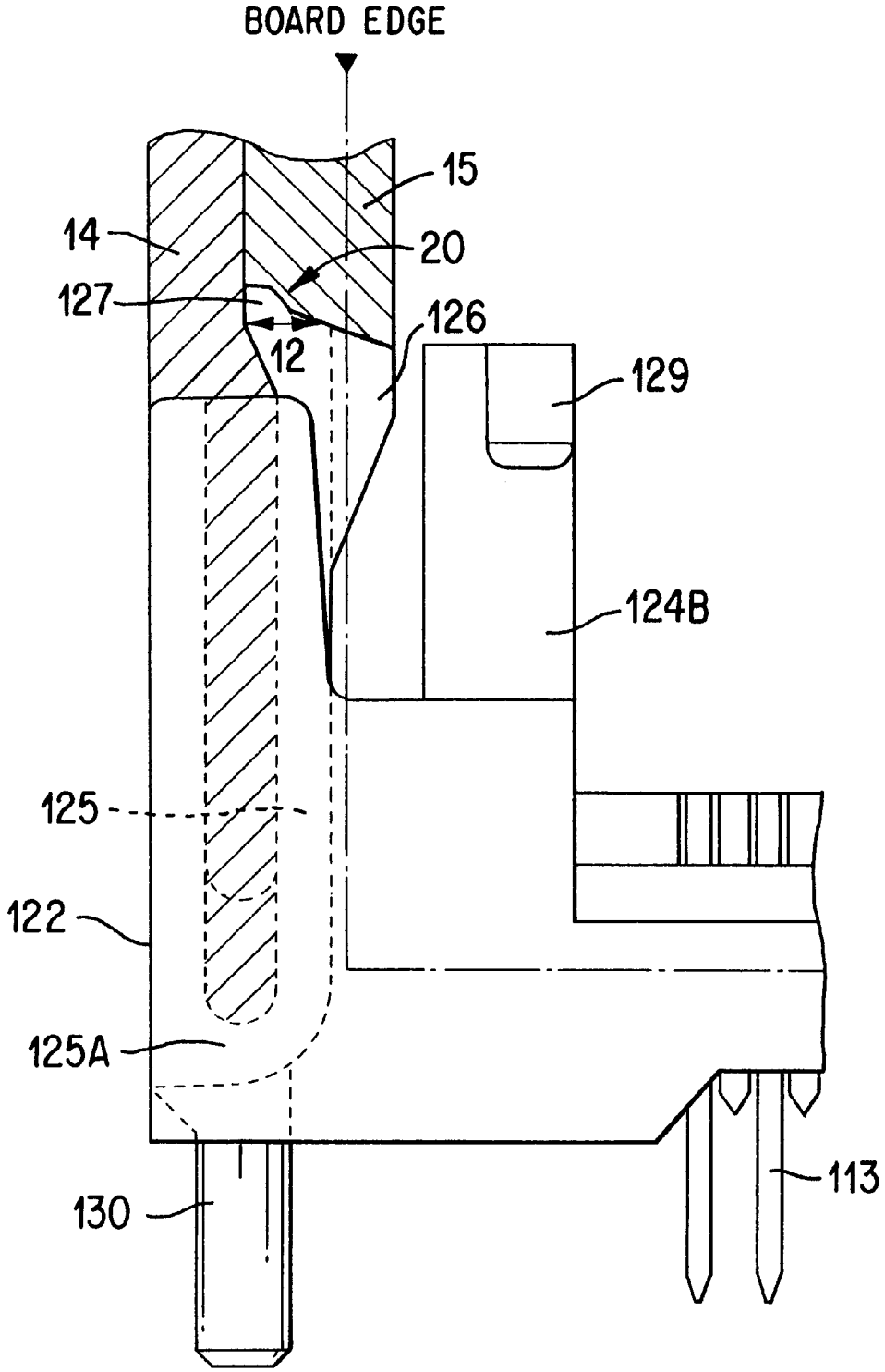
FIG. 12 PRIOR ART
FIG. 12 is a sectional view taken along line 12—12 of FIGS. 10 and 11, together with the mold.

Unlike the conventional device of FIG. 12, the knob 20 of the engaging arm 125 does not extend outwardly but upwardly from the engaging arm 125, with the outside surface flush with that of the engaging arm 125. However, the widths 12 (FIGS. 4 and 12) of the knob 20 and the vertical portion of the engaging arm 125 are made the same as the conventional ones to maintain the maneuverability. Consequently, the engaging arm 125 is shifted outwardly by a degree equal to the projection of the conventional knob. This outward shift of the engaging arm 125 reduces the distance between the side wall 122 and the engaging arm 125 so that it is difficult to flex the engaging arm 125 outwardly. In order to solve such a problem, the side wall 122 is made shorter than the conventional one. For example, the height of the side wall 122 is on a level with the lower end of the hook portion 126.

The thickness of the engaging arm 125 gradually decreases from the side wall 122 to the free end so that when the engaging arm is flexed, the surface stress is distributed evenly at each point of the engaging arm. The joint between the engaging arm 125 and the side wall 122 is lower than the bottom of the board receiving slot 111 so as to provide the engaging arm 125 with high flexibility within the limited height of the insulation housing.

Figure 4:
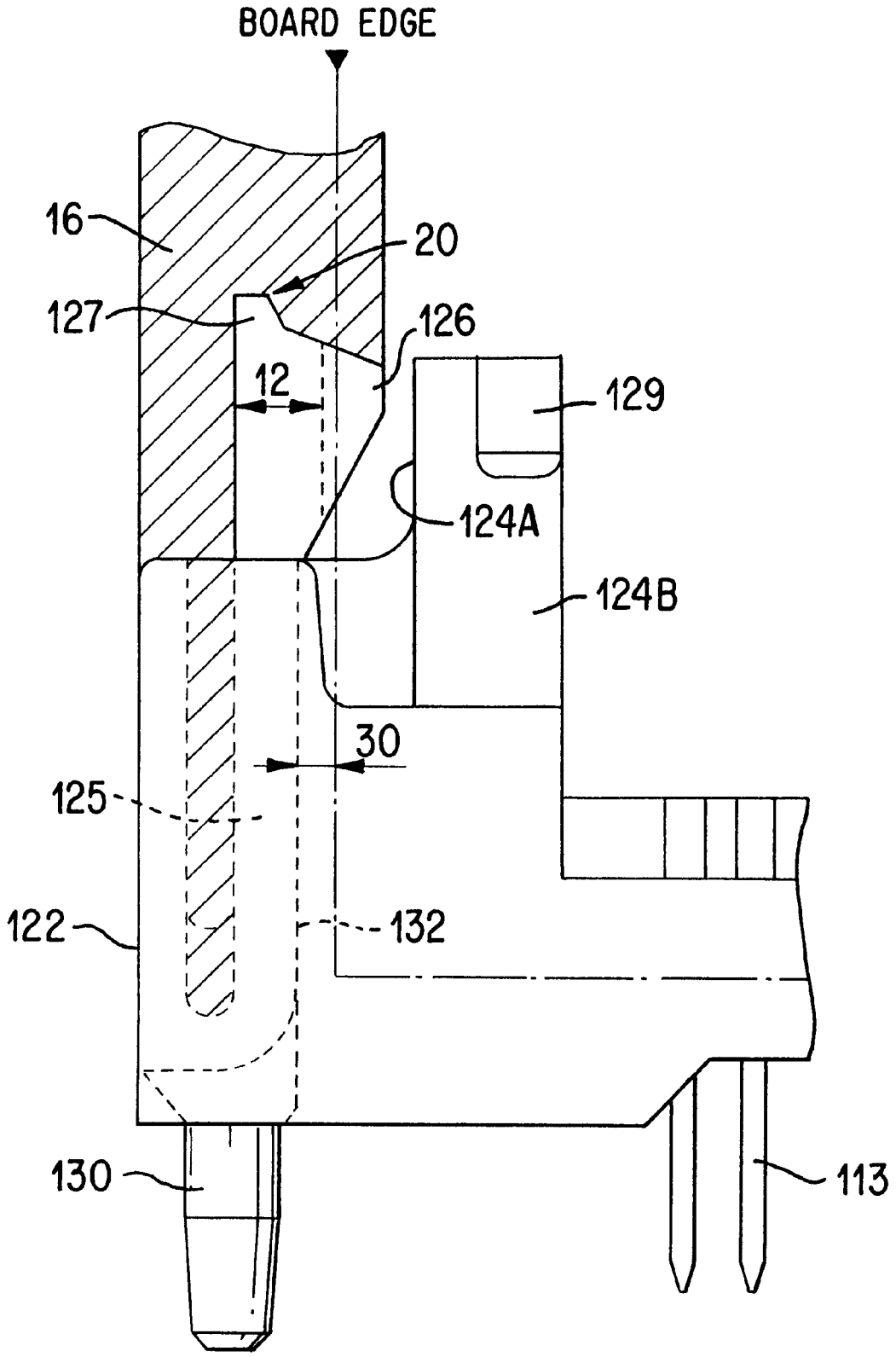
FIG. 4 is a sectional view taken along line 4—4 of FIGS. 1 and 2.

The shape of a metal mold for forming the knob 20 is shown by hatching 16 in FIG. 4. The knob 20 does not project outwardly but is flush with the vertical portion of the engaging arm so that the metal mold 16 has a corresponding flat surface. Consequently, it is not necessary to provide the metal mold 16 with the sequence structure and to make two mold halves but it is possible to make a single metal mold which is removable in one direction.

Figure 5:
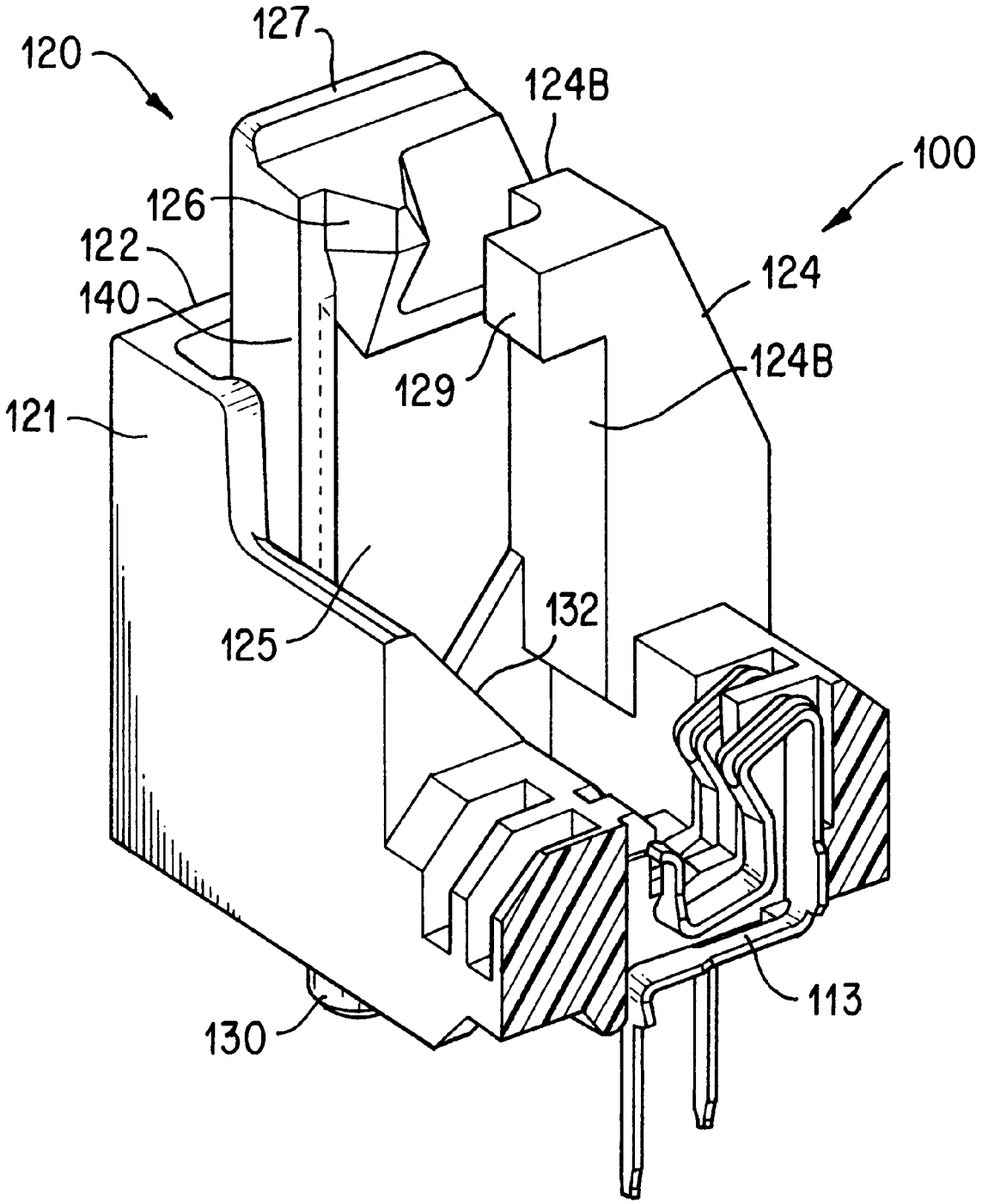
FIG. 5 is a perspective view of an electrical connector according to another embodiment of the invention.

Another embodiment of the invention is shown in FIG. 5, wherein an improvement is made to the engaging arm. In the conventional device and the device of FIGS. 1–4, it is difficult to position a board accurately because of a gap between the side edge of a board (shown by broken line in FIG. 4) and the inside face 132 of the engaging arm 125. Especially, where the engaging arm 125 is shifted outwardly, the gap increases, making the problem worse. A ridge 140 is provided on the vertical portion of the engaging arm 125 to facilitate the positioning of a board upon insertion and rotation. The gap between the ridge 140 and the side edge of a board is sufficiently small to prevent play but sufficient large to allow smooth insertion of a board. The ridge 140 is provided at such a position as to abut the side edge of a board upon insertion and has a sufficient length to position the board. For example, it extends from the lower end to the upper end of the vertical portion of the engaging arm 125. The face of the ridge 140 to guide the side edge of a board may be rounded or papered to facilitate the insertion or rotation.

A fixing stud 130 extend downwardly from the lower face of the insulation housing 100 to position the insulation housing 100 on a printed circuit board (not shown) for mounting. The fixing stud 130 is molded integrally with the board latch 120 so as to increase the strength of the engaging arm 125.

The horizontal portion 125A of the L-shaped engaging arm 125 is joined with the lower end of the side wall 122. A gap (not shown) is provided between the horizontal portion 125A and the fixing stud 130 so that the free end of the engaging arm 125 flexes in not only the longitudinal direction but also the lateral direction of the insulation housing. Also, it is sufficiently flexible to be twisted as described in Japanese patent application Kokai No. 272796/95.

How to insert a board to the electrical connector will be described with reference to FIGS. 6 and 7, wherein a board is inserted and latched, respectively.

Figure 6:
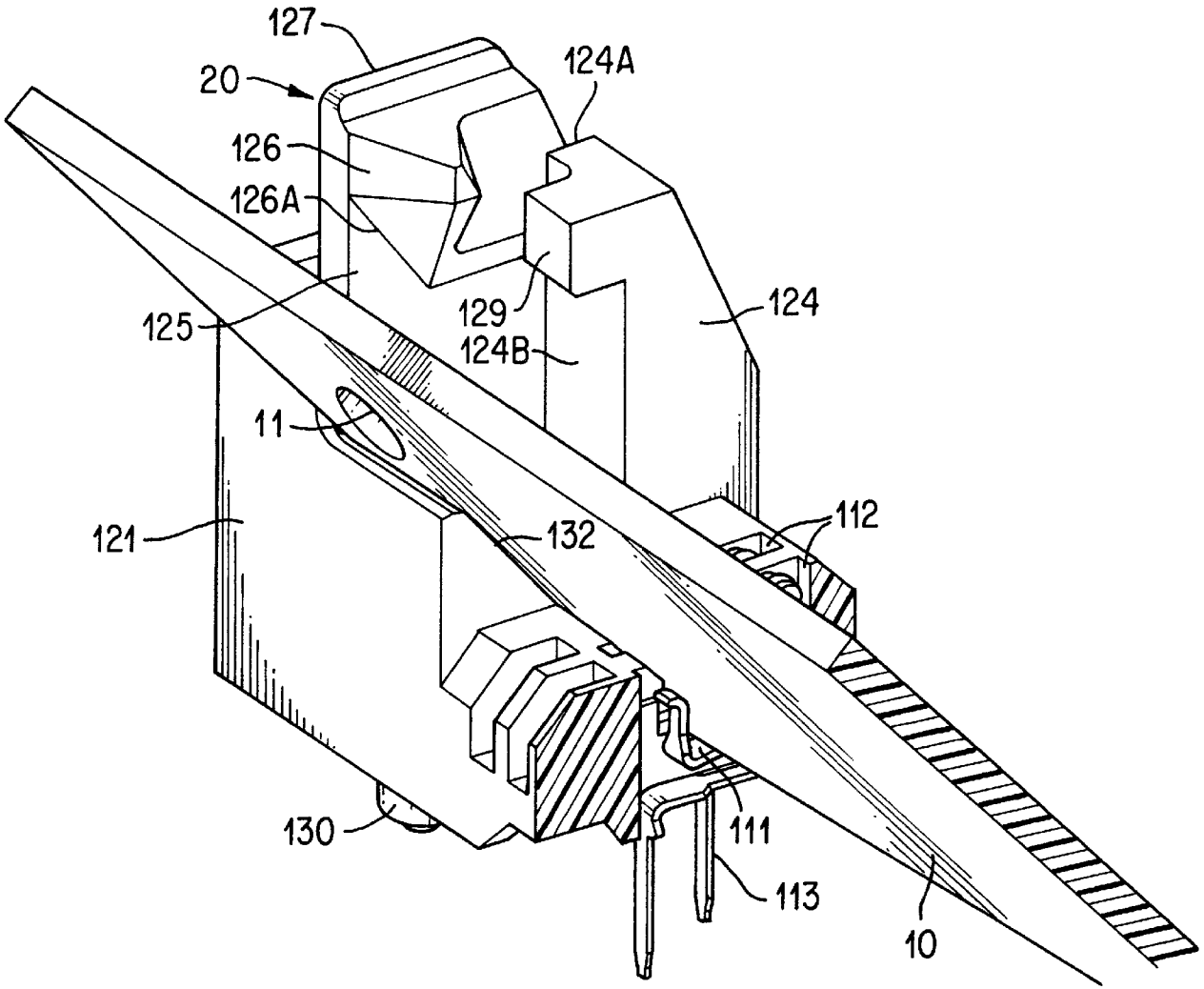
FIG. 6 is a perspective view of the electrical connector of FIG. 1 to which a board is been connected.

As shown in FIG. 6, a board 10 is inserted into the board receiving slot 111 of the central section 110 at an angle, for example, about 30° with respect to the vertical line such that the pads on the board 10 correspond to the contact terminals 113 in the board receiving slot 111. Then, the board 10 is rotated toward the abutment wall 124B of the board latch 120 against the spring force of the contact terminals 113.

When the board 10 is further rotated, it pushes the cam face 126A of the hook portion 126 so that the engaging arm 125 is flexed outwardly at the joint with the side wall 122, and the hook portion 126 is moved outwardly. Consequently, the board 10 passes the hook portion 126 and abuts against the abutment wall 124B. Then, the engaging arm 125 is returned to the original position so that the retaining faces 126B of the hook portions 126 snap the board 10 at opposite side edges, with the positioning hole 11 of the board 10 fitted over the positioning projection 129 of the board latch 120. The positioning projection 129 does not fitted into the positioning hole 11 when the board front edge is not correctly received by the board receiving slot. The size, shape, and position of the positioning projection 129 depends on the positioning, maneuverability, and insertion error preventing function. Such conditions are shown in FIG. 7.

Figure 7:
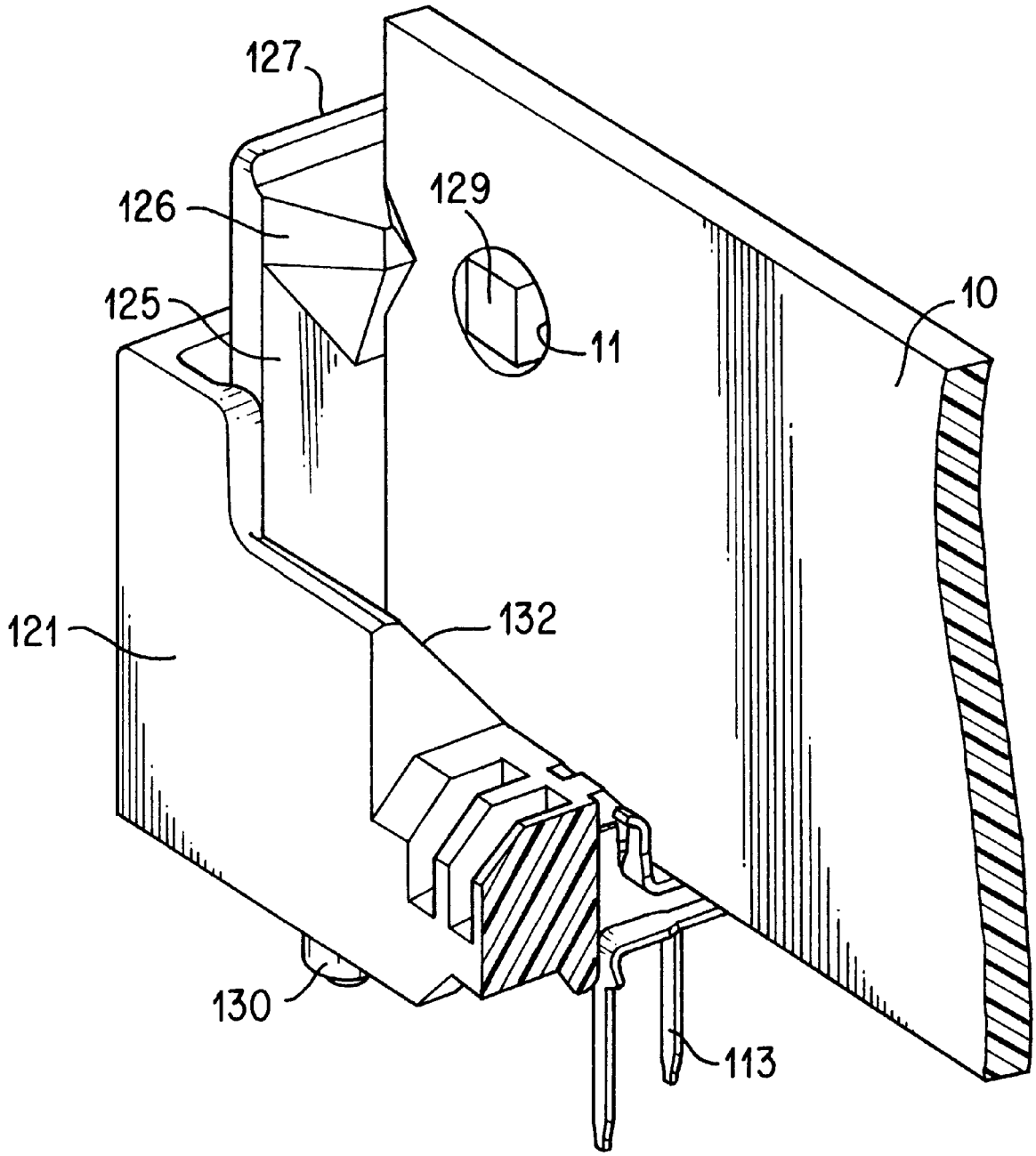
FIG. 7 is a perspective view of the electrical connector of FIG. 1 to which the board has been connected.

Under the conditions of FIG. 7, the board 10 is latched to the insulation housing 100 between the abutment wall 124B of the board larch 120 and the retaining face 126B of the hook portion 126 so as to bring the pads of the board 10 into contact with the contact terminals in the board receiving slot 111.

To release the board 10 from the latch conditions of FIG. 7, the projections 127 of the engaging arms 125 are pushed outwardly so as to flex the engaging arms 125 outwardly to release the retaining faces 126B of the hook portions 126 from the side edges of the board. The board 10 is rotated by the bias of the contact terminals 113 in the board receiving slot 111 toward the position in FIG. 6. Now, the board 10 is removable from the board receiving slot 111. Upon removal, the contact force of the contact terminals to the board 10 is substantially zero as the zero-insertion-force connector, and a very small pulling force is required to remove the board.

Figure 8:
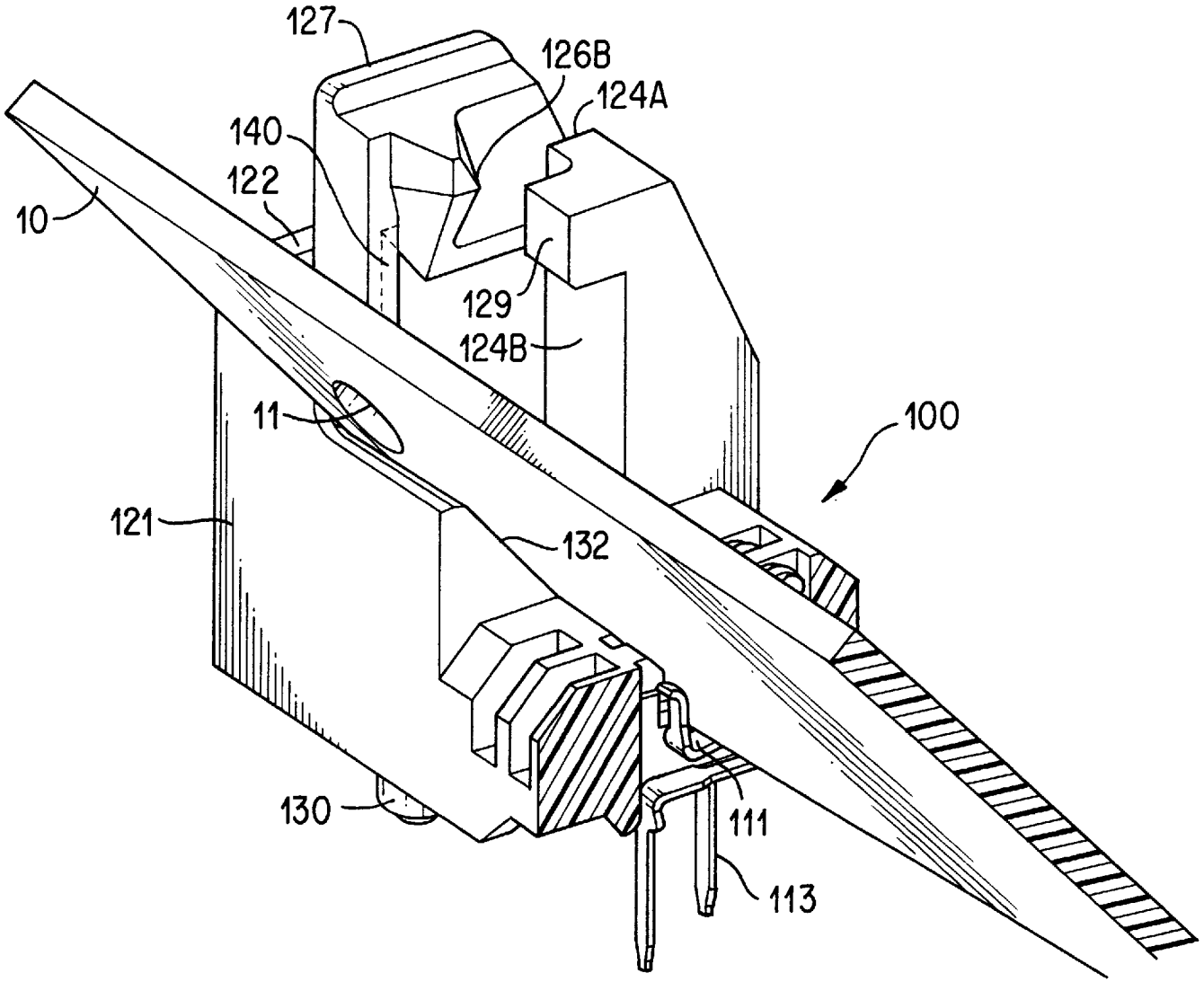
FIG. 8 is a perspective view of the electrical connector of FIG. 5 to which a board is being connected.
Figure 9:
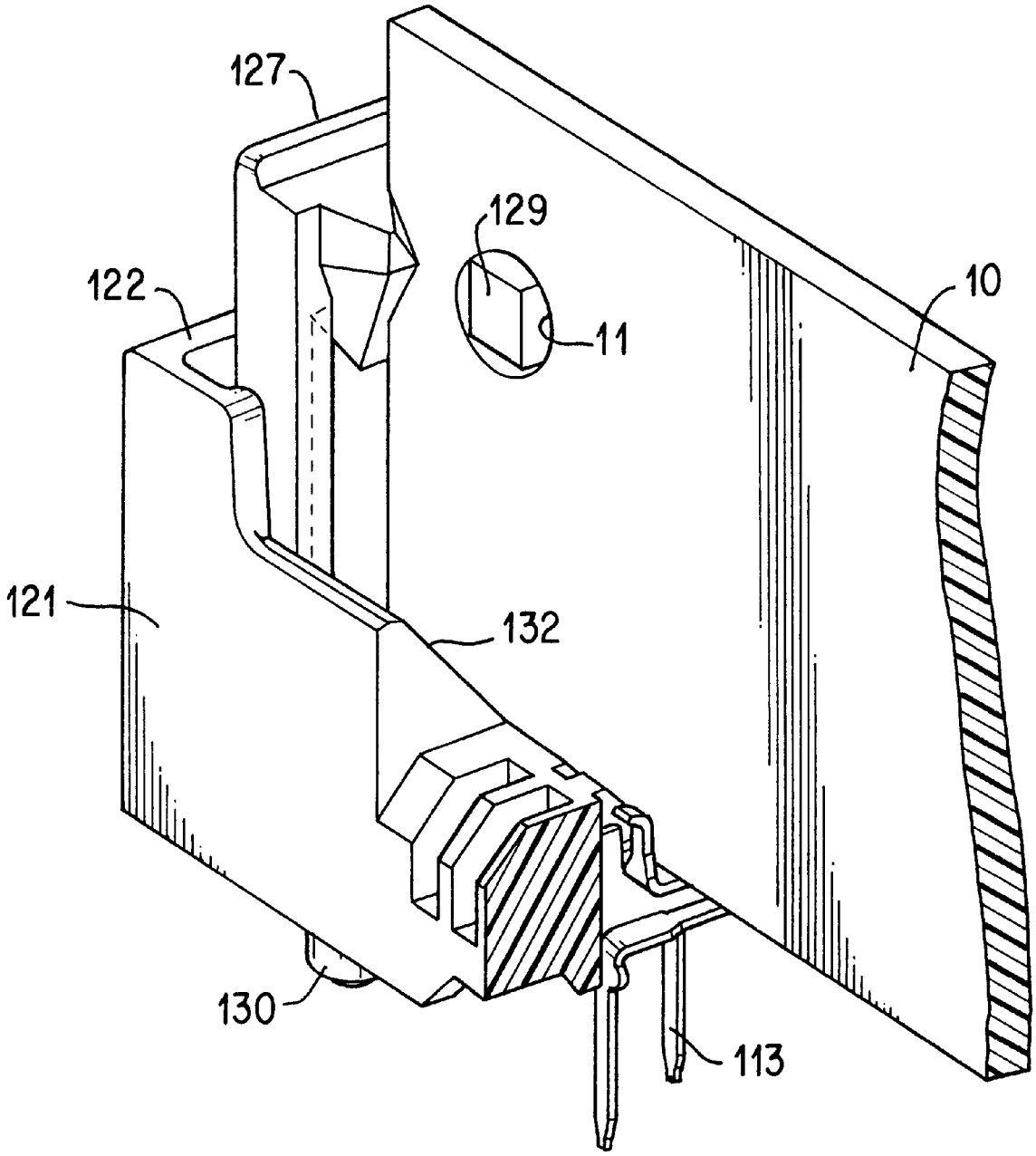
FIG. 9 is a perspective view of the electrical connector of FIG. 5 to which the board has been connected.
Figure 10:
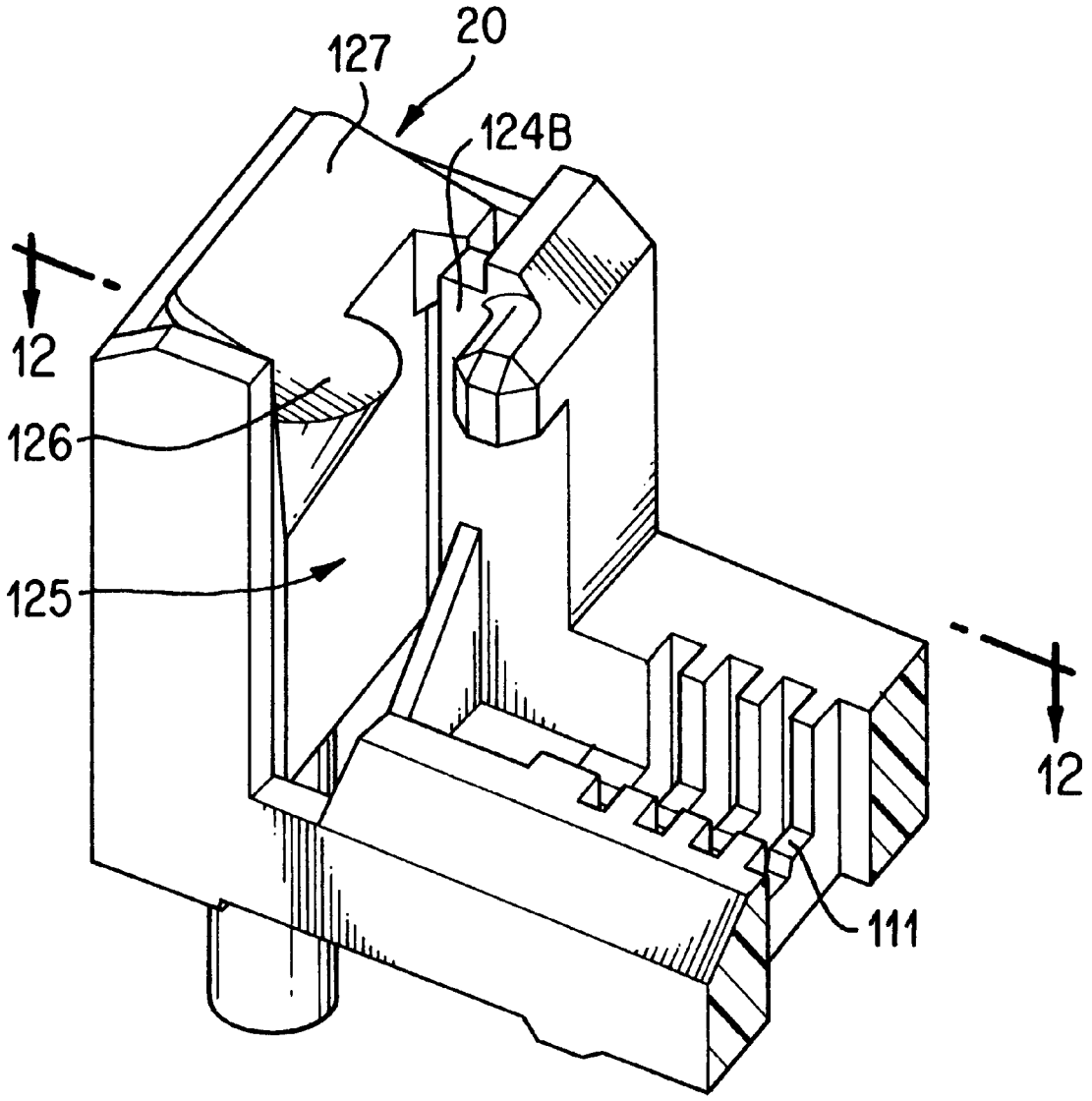
FIG. 10 PRIOR ART
FIG. 10 is a perspective view of a conventional electrical connector having a board latching section.
Figure 11:
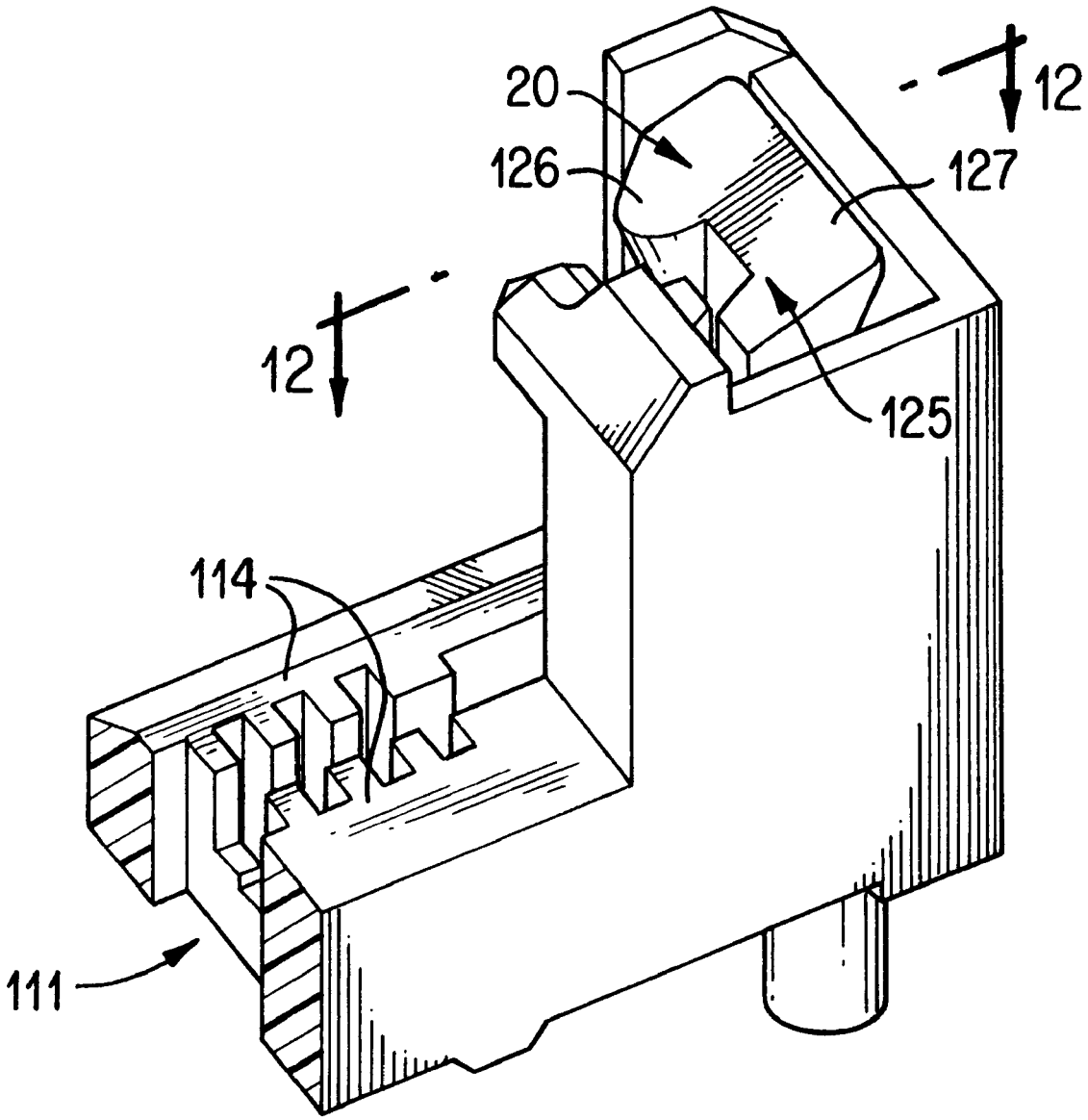
FIG. 11 PRIOR ART
FIG. 11 is a perspective view of the conventional electrical connector viewed from the back.

The operation of the ridge 140 is shown in FIGS. 8 and 9. The basic operation, however, is the same as above in FIGS. 6 and 7. In FIG. 8, the left edge of the board 10 is positioned by the ridge 140 of the engaging arm 125 so that the pads (not shown) of the board 10 correspond to the contact terminals 113 in the board receiving slot 111. When the board 10 is rotated, it is guided by the ridge 140 so that there is no play but the rotation is very smooth. When the board is latched as shown in FIG. 9, the pads of the board 10 correspond accurately to the contact terminals 112 in the board receiving slot 111

The L-shaped engaging arm is surrounded by the walls for protection from excessive load in the above embodiment but, in place of the walls, hook mechanisms may be provided to restrict the flexure in every direction of the engaging arm.

As has been described above, according to the invention, the undercut portion of a metal mold for forming the engaging arm is eliminated so that the metal mold is simplified. Consequently, there is neither sequence structure nor sliding parts required so that parts biting is eliminated. The costs of maintenance and manufacturing of the metal mold are reduced and the molding cycle is shortened. Since the resin bites or sticks to the movable metal mold or the core pins for forming holes to fix the contact terminals, it is not necessary to make an undercut portion for removing the insulation housing. Consequently, fewer burrs are made, and the cost for making the metal mold is reduced.

Thus, it is possible to make the board latch with a knob without lowering the maneuverability of the engaging arm and the use of an undercut portion.

In addition, the ridge on the engaging arm positions and guides accurately a board into the board receiving slot. Consequently, the pads of the board accurately correspond to the contact terminals without play. Since it is guided by the ridge, the board is connected to the electrical connector with ease.

What is claimed is:

1. An electrical connector, comprising:

an insulation housing with an elongated central section and at least one side wall extending upwardly at an end of said central section;

a board receiving slot provided in said central section to extend in longitudinal direction of said central section;

a plurality of contact terminals arranged in said board receiving slot;

at least one board latch extending upwardly from an end of said board receiving slot for latching a side edges of said board inserted into said board receiving slot such that pads of said board are brought into contact with said contact terminals, said board latch comprising:

an L-shaped engaging arm extending laterally from a joint with said side wall and then upwardly to form a vertical portion with a free end so that an outside face of said free end is flush with an outside face of said vertical portion thereby eliminating an undercut portion of metal mold;

a hook portion provided on an inside face of said free end; and an abutment wall cooperating said hook portion for holding side edge of said board between said hook portion and said abutment wall.

2. An electrical connector according to claim 1, wherein said side wall has a height lower than a lower end of said hook portion.

3. An electrical connector according to claim 1 or 2, wherein said joint with said engaging arm is lower than a lower face of said board receiving slot.

4. An electrical connector according to claim 1 or 2, wherein said engaging arm has a thickness which gradually decreases in said longitudinal direction from said joint to said free end so that a surface tension is distributed evenly at each point of said engaging arm upon flexing.

5. An electrical connector according to claim 1 or 2, which further comprises flexure restricting means for surrounding said free end except said hook portion to restrict flexure of said engaging arm in different directions.

6. An electrical connector according to claim 1 or 2, which further comprises a projection provided on said fee end to enhance maneuverability of said engaging arm.

7. An electrical connector according to claim 1 or 2, which further comprises a fixing stud molded integrally with said engaging arm.

8. An electrical connector according to claim 1 or 2, which further comprises a ridge provided on said engaging arm so as to position said board in said longitudinal direction into said board receiving slot.

9. An electrical connector according to claim 8, wherein said ridge extends from a lower end to an upper end of said vertical portion of said engaging arm so as to guide and position said board.

10. An electrical connector according to claim 9, wherein said ridge is spaced from said side edge of said board with a gap which is sufficiently small to position accurately said board without play but sufficiently large to slide said board without difficulty.

11. An electrical connector according to claim 9, wherein said ridge is rounded or tapered.

12. A method for making an electrical connector according to claim 1, wherein said side wall and said engaging arm are molded with a single metal mold.

* * * * *